US005129203A

United States Patent [19]

Romero

[11] Patent Number: 5,129,203

[45] Date of Patent: Jul. 14, 1992

[54] BUILDING PANEL CORE

[76] Inventor: Arturo J. Romero, 16410 Delozier, Houston, Tex. 77040

[21] Appl. No.: 558,309

[22] Filed: Jul. 26, 1990

[51] Int. Cl.[5] ..... E04C 2/24

[52] U.S. Cl. ..... 52/309.11; 52/309.9; 52/309.12; 52/309.14; 52/309.17

[58] Field of Search ..... 52/383, 309.11, 309.9, 52/309.12, 309.14, 309.17

[56] References Cited

U.S. PATENT DOCUMENTS

| | | | |
|---|---|---|---|
| 4,104,842 | 8/1978 | Rockstead et al. | 52/383 |
| 4,226,067 | 10/1980 | Artzer . | |
| 4,291,732 | 9/1981 | Artzer . | |
| 4,340,802 | 7/1982 | Artzer . | |
| 4,505,019 | 3/1985 | Deinzer | 52/309.11 |
| 4,742,986 | 5/1988 | Csont | 249/210 |

*Primary Examiner*—Michael Safavi
*Attorney, Agent, or Firm*—Browning, Bushman, Anderson & Brookhart

[57] ABSTRACT

A structural panel core is disclosed for forming a wall or the like. The wall is formed using the structural panel core by adding an inner cementitious layer adjacent the filler layer and enclosing the interior lattice structure, and an outer cementitious layer adjacent the filler layer and enclosing the exterior lattice structure. The panel core includes an interior lattice structure, an exterior lattice structure, and a substantially continuous filler layer between the lattice structures. A plurality of connecting members each passed through the filler layer and fixedly interconnect the lattice structures, with each of the connecting members being secured at a compound inclination to the lattice structure such that an inclined angle is formed between each connecting member and any plane perpendicular to either interior or exterior lattice structures. According to the method of the present invention, substantially continuous filler layer is positioned between the interior and exterior lattice structures, and the connecting members are passed through the filler layer at the compound inclination to the interior and exterior lattice structures, then weldly connected at each end to the lattice structures.

17 Claims, 2 Drawing Sheets

BUILDING PANEL CORE

BACKGROUND OF THE INVENTION

1. Field of the Invention

The present invention relates to structural panels used to fabricate building walls, roofs and/or floors. More particularly, this invention relates to a light-weight building panel core of the type comprising in outer lattice, and inner lattice and a light-weight filler between the lattices. At the building installation site, a cementitious layer may be added to each side of the filler layer to enclose the respective lattice.

2. Description of the Background

Much effort has been expended for decades and considerable advancements have been made to reduce building costs. This effort has lead to increased use of fully prefabricated building panels throughout the world, which are shipped to the construction site then assembled to form building walls, roofs or floors. A substantially disadvantage of this technique is the expense of transportation, especially when the construction site is remote from the panel manufacturing plant. Accordingly, increased emphasis has recently been placed on building panel cores, which are substantially light-weight and thus have low shipping cost. The cores are shipped to the construction site, the panels are then interlocked to form the desired configuration for walls, ceilings or floors for the building, and the cementitious layer is then applied to the cores to form the completed panels.

Building panel cores are generally of three types. U.S. Pat. Nos. 4,226,067 and 4,340,802 disclose a structural panel which comprises an outer lattice, an inner lattice, and sinuous rods which interconnect the lattices. Each of the rods lie within a substantially single plane, so that the spacing between the lattices and between adjacent sinuous rods may be filled with elongate strips of light-weight filler material. The filler material may comprise polystyrene or urethane foam materials, and the strips are slid in place between the lattice and the sinuous rods to form the cores, which typically comprise 4' by 8' panels.

A second type of building core is commonly referred to as a foamed-in-place panel. This type of building core utilizes similar inner and outer lattices and interconnecting rods, although the rods which connect the lattices need not each lie within a single plane since the filler material is first formed in its desired final position between the inner and outer lattices. A significant disadvantage of this type of panel is the high cost of the equipment required to uniformly form the filler material in place between the lattices.

A third type of building core utilizes a conventional sheet of filler material, and the lattice layers are then positioned on each side of the sheet. The interior lattice is interconnected with the exterior lattice by a plurality of straight rods or wires which pierce through the filler material. The ends of the rods are welded or otherwise attached to the inner and outer lattice structures to complete the core. Because this latter technique utilizes low cost planar sheets of foam for the filler material rather than individual strips, and expensive formed in place machinery is not required, it is often the preferred type of building core.

One of the significant limitations to increase use of building cores to reduce construction cost is the somewhat justified concern that these panels will not withstand high forces of the type which are transmitted to the building in high winds, earthquakes, etc. The present invention is directed to providing improved building panels, and to improved building panel cores which overcome the limitations of prior art panels. In particular, the structural panels of the present invention have low manufacturing cost yet increase the ability of the panels to reliably withstand external forces.

SUMMARY OF THE INVENTION

A structural panel core is provided for forming a wall, ceiling, floor or the like of a building. The panel core includes an interior lattice structure, and exterior lattice structure, and a substantially continuous filler layer between the interior and exterior structures. A panel is formed by adding an inner cementitious layer adjacent the filler layer and enclosing the interior lattice structure, and an outer cementitious layer adjacent the filler layer and enclosing the exterior lattice structure. The structural panels formed by the cores of the present invention may be interconnected by conventional means to achieve the desired wall or the like.

The interior lattice structure includes the first plurality of substantially parallel elongate reinforcing members and a second plurality of substantially parallel elongate reinforcing members interconnected to the first plurality of reinforcing members, with the first and second reinforcing members defining an interior plane. The exterior lattice structure similarly includes a third plurality of substantially parallel elongate reinforcing members and a fourth plurality of substantially parallel elongate reinforcing members each fixedly connected to the third plurality of reinforcing members, with the third and fourth plurality of reinforcing members defining an exterior plane. A plurality of connecting members are each passed through the filler layer and fixedly interconnect the interior and exterior lattice structures, with each of the connecting members being fixedly secured at a compound inclination to the lattice structures, such that an inclined angle is formed between each connecting member and any plane perpendicular to either the interior or exterior planes. Each of the lattice structures may define a square grid configuration and form substantially parallel planes, such that the first plurality of elongate reinforcing members and an opposing one of the third plurality of elongate reinforcing members define a plane perpendicular to both the interior and exterior planes.

Each of the reinforcing members are preferably metal wires which are fixedly interconnected by welds. The filler layer has a substantially uniform thickness, and is positioned mid-way between the interior and exterior lattice structures such that each lattice structure is spaced from the filler material to accommodate the respective inner and outer cementitious layers.

According to the method of the present invention, the light-weight structural panel core is fabricated by forming the respective interior and exterior lattice structures, and then positioning a continuous filler layer between these structures. Connecting members are then passed through the filler layer at a compound inclination, and are weldably connected at each end to the interior and exterior lattice structures. Adjacent interconnecting members may form the edges of a truncated pyramid extending between the lattice structures. One row of truncated pyramids may each have their imaginary apexes spaced from an interior side of the core, while the next layer of truncated pyramids has its imaginary apexes spaced from an exterior side of the core.

It is an object of the present invention to provide an improved low cost structural panel core for forming a wall or the like, wherein the wall includes an inner cementitious layer adjacent the filler layer and enclosing an interior lattice structure, and an outer cementitious layer adjacent the filler layer and enclosing an exterior lattice structure.

It is a further object of the present invention to provide a structural panel core with improved reinforcing which may be used for forming a wall or the like.

Yet another object of the present invention is to provide a structural panel core with a plurality of connecting members each passing through the filler layer and fixedly interconnecting the interior lattice structure with the exterior lattice structure, with each of the connecting members being fixedly secured at a compound inclination to the lattice structures such that at an inclined angle is formed between each connecting member and any plane perpendicular to either the interior or exterior planes of the respective interior or exterior lattice structures.

It is a feature of the present invention that each of the elongate reinforcing members which define the interior and exterior lattice structures and each of the connecting members may be formed from metal wire.

It is a further feature of the present invention that the metal wire members may be fixedly interconnected by welds.

Yet another feature of the invention is that the structural panel core includes a continuous filler layer having a substantially uniform thickness and positioned substantially mid-way between the interior and exterior lattice structures.

A significant advantage of the present invention is that a light-weight structural panel core having increased structural integrity may be formed utilizing a relatively low cost machine which passes connecting members through the filler layer and subsequently welds the connecting members to the interior and exterior lattice structures.

These and further objects, features, and advantages of the present invention will become apparent from the following detailed description, wherein reference is made to the figures in the accompanying drawings.

DETAILED DESCRIPTION OF THE PREFERRED EMBODIMENTS

Figure 1:
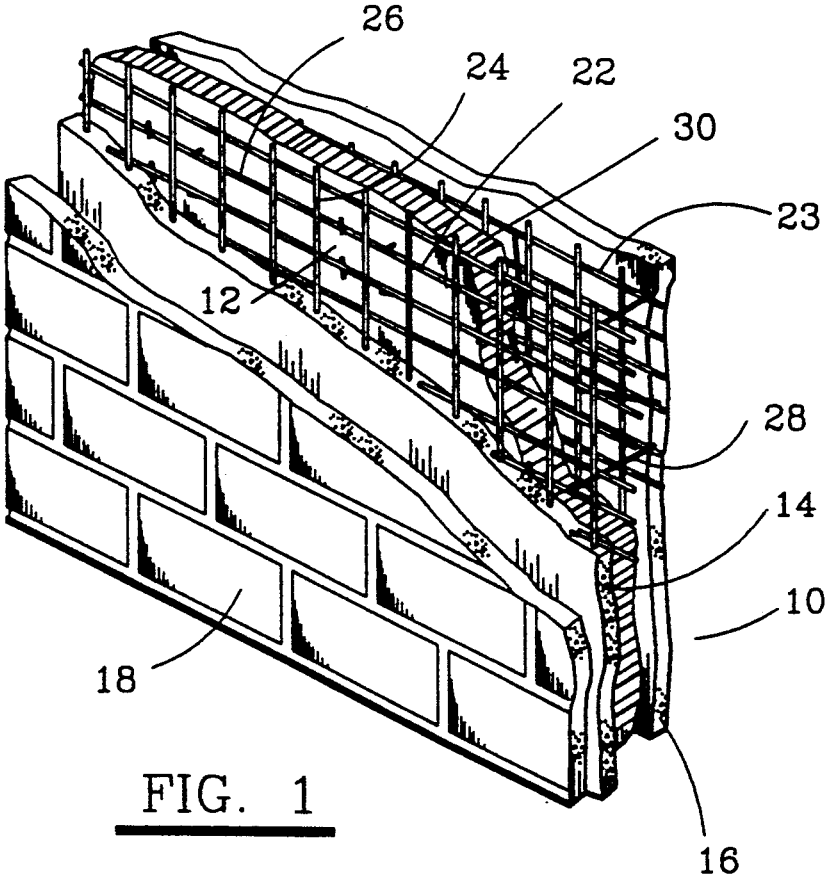
FIG. 1 is a pictorial view, partially in cross-section, of the components of a structural panel core and a wall formed from the panel core of the present invention.

FIG. 1 illustrates a structural panel 10 for a wall formed from a panel core 12 according to the present invention. In addition to the core 12 described in detail subsequently, the wall 10 comprises an outer cementitious layer 14, an inner substantially identical cementitious layer 16, and an exterior brick or other exterior layer 18. As used herein, the word cementitious is intended to emcompass any materials having a cement-like base, including concrete, mortar, gunnite, or plaster.

The core 12 comprises an exterior lattice structure 22 and an interior lattice structure 23, with the lattice structures being interconnected by the plurality of connecting rods or wires 28. Each lattice structure includes a first plurality of substantially parallel vertical reinforcing members or wires 24 and a second plurality of substantially parallel reinforcing members or wires 26, with the wires of the lattice structures being interconnected by welds. The exterior lattice structure 22 including its horizontal and vertical wires define an exterior plane, and the interior lattice structure 23 including its horizontal and vertical wires defines an interior plane. A filler layer 30 having a substantially uniform thickness is positioned midway between the interior and exterior lattice structures.

The inner and outer cementitious layers are each adjoining the filler layer 30 and enclose a respective lattice structure, as shown. The interior plane and the exterior plane defined by the lattice structures are substantially parallel. Any one of the vertical reinforcing members of the interior lattice structure and an opposing one of the elongate reinforcing members of the exterior lattice structure define a plane perpendicular to both the interior and exterior planes. Similarly, one of the horizontal elongate reinforcing members of the interior lattice structure and an opposing one of the horizontal elongate reinforcing members of the exterior lattice structure define another plane which is also perpendicular to both the interior and exterior planes. The reinforcing members of each lattice structure may define a square grid configuration, and the connecting members 28 pass through the filler layer and fixedly interconnect the inner lattice structure with the exterior lattice structure. Each connecting member is fixedly secured at a compound inclination to each of the interior and exterior lattice structures, such that an inclined angle is formed between each connecting member and any plane perpendicular to either the interior plane or the exterior plane. In other words, each of the connecting members 28 is neither parallel to either the interior or exterior planes defined by the respective interior and exterior lattice structures, nor does the connecting member lie within a plane which is perpendicular to either the interior or exterior planes.

Figure 2:
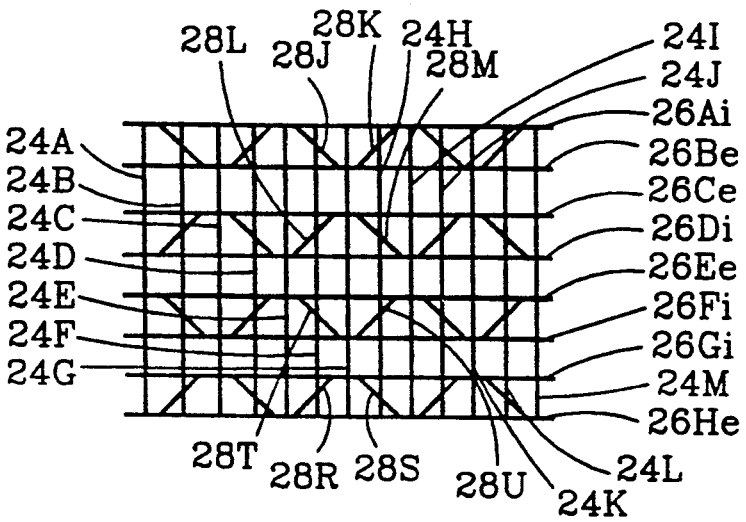
FIG. 2 is a side view of the interior and exterior lattice structures and the connecting members for a portion of a structural panel core as shown in FIG. 1.

FIG. 2 depicts a side view of only a portion of the exterior lattice structure 24, the interior lattice structure 23, and the connection members 28, with the filler material layer 30 removed for clarity of these components. The substantially parallel elongate vertical reinforcing members 24 and the substantially horizontal elongate reinforcing members 26 are aligned, i.e., each vertical member and horizontal member of the interior lattice structure 23 is directly behind a corresponding vertical and horizontal member of the exterior lattice structure 24 when facing toward the interior of the core 12 as depicted in FIG. 1. For purposes of explanation, however, the designations "e" and "i" will occasionally be used following the reference number and capital letter designations to represent exterior and interior lattice structure members, respectively.

The portion of the exterior lattice structure 24 shown in FIG. 2 thus comprises rows of straight horizontal reinforcing members 26A, 26B, 26C . . . 26H, and columns of straight vertical members 24A, 24B, 24C . . .

24M. These members are connected by welds at at least some of their junctions, and the lattice structures as well as the filler layer may be purchased components. The connecting members 28 between the lattice structures may be arranged in various uniform patterns, with a suitable pattern being a frustopyramid shape. Accordingly, the connecting members 28J, 28K, 28L and 28M may define the edges of the frustoconical pyramid which is projecting outwardly, i.e., its imaginary apex is outside the cementitious layer 14. Four members 28 thus define a single pyramid, and all pyramid in the A, B, C and D rows 26 as shown in FIG. 2 may be outwardly projecting pyramids, while the pyramids in the rows E, F, G and H are inwardly projecting pyramids. Thus interconnecting members 28J and 28K are each welded at one end to 26Ai, and at their opposing end to 26Be, while members 28L and 28M are similarly each connected at one end to 26Di and at their other end to 26Ce. The next row of pyramids are inwardly projecting, and accordingly 28T and 28U are each connected at one end to 26Ee and at their opposing end to 26Fi, while the members 28R and 28S are similarly connected at one end to 26Gi and at their opposing end to 26He. The series of similar pyramid shapes defined by the interconnecting members 28 are preferably arranged in rows, as explained above, or in columns, but also may be arranged in diagonals rather than rows or columns.

Figure 3:
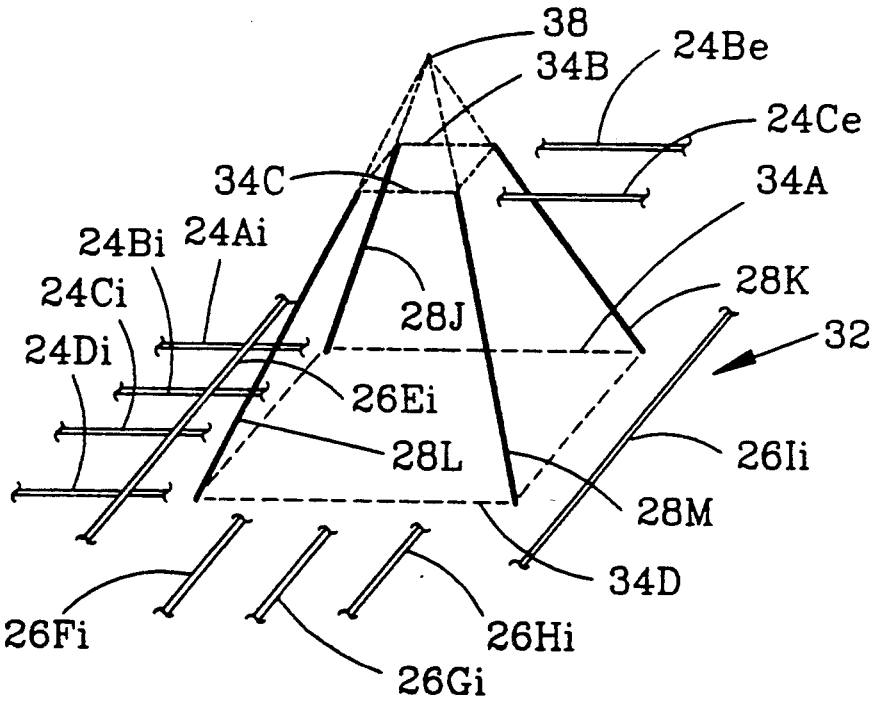
FIG. 3 is a pictorial view illustrating the representative position of the elongate reinforcing members which define the interior and exterior lattice structures and a grouping of the connecting members which define the edges of a truncated pyramid.

FIG. 3 illustrates more clearly the frustoconical pyramid pattern formed by the interconnecting members 28J, 28K, 28L and 28M. The base of the imaginary pyramid is defined by 34A and 34D aligned with members 24Ai and 24Di, respectively. The other two sides of the base are defined by parallel lines midway between members 26Ei and 26Fi, and between 26Hi and 26Ii, respectively. Similarly, the top of the pyramid is defined by sides 34B and 34C which are aligned with rods 24Be and 24Ce, respectively. The opposing sides of the top would lie midway between members 26Fe and 26Ge, and between 26Ge and 26He, as generally shown in FIG. 2. The pyramid formed by members 28J, 28K, 28L and 28M have an imaginary apex 38.

Referring to both FIGS. 2 and 3, it should now be better understood how the interconnecting members between rows 26A and 26D are each outwardly projecting frustoconical pyramids, while the interconnecting members between rows 26E and 26H define inwardly projecting frustoconical pyramids. As previously noted, the frustoconical pyramid configuration formed by four of the interconnecting members is preferred, although the interconnecting members may be arranged in other shapes, such as pyramids having three, six, or eight sides.

The method of forming a light-weight structural panel according to the present invention will now be described. The interior and exterior lattice structures may either be formed from metal wires or rods, or may be purchased as a grid. In any event, the interior or exterior lattice structures may be identical, and include a plurality of parallel elongate first reinforcing members and a plurality of second parallel elongate reinforcing members each substantially perpendicular to the first members. The lattice structures are preferably arranged during the process of forming the panel core such that the interior plane defined by the interior lattice structure is substantially parallel to the exterior plane defined by the exterior lattice structure. The reinforcing members of each lattice structure thus define a rectangular-shaped grid, and preferably a lattice structure with a square grid pattern. A low-cost substantially continuous filler layer 30 as shown in FIG. 1 may then be positioned between the interior and exterior lattice structures. The filler layer is positioned between the lattice structures and with a preselected gap existing between the surface of the filler layer and the corresponding interior and exterior lattice structures. An automated machine may then be used to pierce straight connecting members through the filler layer at a compound inclination to each of the interior and exterior lattice structures, such that an inclined angle is formed between each connecting member and any plane perpendicular to either the interior or exterior planes formed by the lattice structures, respectively. Finally, each end of the connecting members is weldably affixed to the interior and exterior lattice structures, respectively. The machine used to pierce connecting members through the lattice structure may be similar to the prior art machine used to form the third type of structural panel described in the background portion of this application, except that the connecting members must be properly positioned in three dimensions rather than in only two dimensions for proper orientation to be interconnected to the lattice structures. The interconnecting members may be arranged each at a preselected angle using conventional technology for piercing through the filler layer so that the ends of each connecting members will be positioned for welding to the interior and exterior lattice structures.

The wall 10 formed with the structural panel core 12 of the present invention can be used for residential buildings, office parks, warehouses, shopping centers, etc. Walls formed from structural panel cores according to the present invention offer a low fire risk, and provide high protection from earthquake damage. Buildings may be constructed at a low cost since the panel cores may be easily shipped to the construction site, the completed panels erected and interconnected, and the cementitious layers then added by quickly trained labor. The monolithic cementitious layer between panels provides desired structural qualities, and the wall provides high thermal insulation due to the light-weight filler layer. Electrical, water and other utility lines may be easily placed within the wall, and the same core may be used for floors, slabs, walls and roofs. Windows and doors may be easily cut into completed panels. Due to the use of the filler layer, a fraction of the cement is used compared to fabricated panels which do not include a filler layer. Due to its light-weight construction, the wall formed from the panel core may be properly and safely used in areas with relatively poor foundation or bearing conditions.

The filler layer may be fabricated from polystyrene or any other light-weight filler material, and each of the lattice structures may be spaced approximately 15 millimeters from the adjacent face of the filler layer. The wire for the lattice structures as well as the wire for the connecting members may have a diameter in the range of from 2 to 4 millimeters, and the parallel reinforcing members of each lattice structure may be spaced approximately 50 to 200 millimeters apart. Further details with respect to suitable materials for the structural panel core, materials for the structural panel formed from the core, the process for fabricating panels, and the technique for weldably connecting members which pass through the filler material and interconnect the interior and exterior lattice structures are disclosed in U.S. Pat. Nos. 4,226,067, 4,291,732, and 4,340,802.

FIGS. 2 and 3 indicate that the end of each connecting member 28 terminate at planes defined by the interior and exterior lattice structures, respectively. It should be understood that the ends of the these members may extend slightly outward of these lattice structures, but preferably not more than about 1/16 of an inch, so that the ends of the connecting members do not engage other components during shipping or handling and thus increase the likelihood of a break in a weld. Also, FIGS. 2 and 3 illustrate that each of the connecting members is positioned approximately midway between corresponding vertical and horizontal reinforcing members, although this connection may be made at any location. Referring to FIG. 3, for example, the ends of 28J and 28L at the pyramid base may be spaced on 24Ai and 24Di closer to 26Ei than to 26Fi, and similarly the ends of 28K and 28M at the base of the pyramid would then preferably be spaced on 24Ai and 24Di equally closer to 26Hi than to 26Ii. It should also be understood that the connection between the reinforcing members of each lattice structure, as well as the connection between the connecting members in each lattice structure, may be made by other than welds. For example, clamps may be used to fixedly join these members together at their junctions, or small diameters wires may be used to wrap about a junction and thereby tie the members together.

The foregoing disclosure and description of the invention is illustrative and explanatory thereof, and various changes in the size, shape, and materials, as well as in the details of the illustrated construction and in the process of forming a structural panel core, may be made within the scope of the appended claims and without departing from the spirit of the invention.

What is claimed is:

1. A structural panel core for forming a wall or the like, the structural panel core including an interior lattice structure, an exterior lattice structure, and a substantially continuous filler layer between the interior and exterior lattice structures, the wall further including an inner cementitious layer adjacent the filler layer and enclosing the interior lattice structure and an outer cementitious layer adjacent the filler layer and enclosing the exterior lattice structure, the structural panel core further comprising:

the interior lattice structure including a first plurality of substantially parallel elongate reinforcing members and a second plurality of substantially parallel elongate reinforcing members each fixedly interconnected to the first plurality of reinforcing members, the first and second reinforcing members defining an interior plane;

the exterior lattice structure including a third plurality of substantially parallel elongate reinforcing and a fourth plurality of substantially parallel elongate reinforcing members each fixedly interconnected to the third plurality of reinforcing members, the third and fourth reinforcing members defining an exterior plane;

a plurality of structurally separate elongate wire segments each having a straight line configuration between opposing terminal ends of each wire segment and passing through the filler layer for fixedly interconnecting the interior lattice structure with the exterior lattice structure, each of the wire segments fixedly secured adjacent a respective opposing terminal end at a compound inclination to each of the interior and exterior lattice structure and at a position spaced from other of the plurality of wire segments, such that each wire segment is structurally supported by the interior and exterior lattice structures and independent of other of the plurality of wire segments, and such that an included angle is formed between each wire segment and any plane perpendicular to either the interior plane or the exterior planes; and each of the plurality of wire segments forming a side of an imaginary pyramid having remaining sides formed by other of the plurality of wire segments, the wire segments being fixedly secured to the interior and exterior lattice structure such that an apex of the imaginary pyramid is spaced opposite one of the lattice structures with respect to the other of the lattice structures.

2. The structural panel core as defined in claim 1, wherein the interior plane is substantially parallel to the exterior plane.

3. The structural panel core as defined in claim 2, wherein:

one of the first plurality of elongate reinforcing members and an opposing one of the third plurality of elongate reinforcing members define a plane perpendicular to both the interior and exterior planes; and one of the second plurality of elongate reinforcing members and an opposing one of the fourth plurality of elongate reinforcing members define another plane perpendicular to both the interior and exterior planes.

4. The structural panel core as defined in claim 1, wherein each of the first, second, third, and fourth elongate reinforcing members are formed from wire members.

5. The structural panel core as defined in claim 1, wherein in each of the wire segments is fixedly interconnected to the interior and exterior lattice structures by welds.

6. The structural panel core as defined in claim 1, wherein the filler layer has a substantially uniform thickness, and is positioned substantially midway between the interior and exterior lattice structures.

7. The structural panel core as defined in claim 1, wherein the plurality of wire segments form a plurality of imaginary pyramids arranged in rows, and wherein a first group of the imaginary pyramids in first rows have their apexes spaced opposite the interior lattice structure with respect to the exterior lattice structure, and wherein a second group of the imaginary pyramids in second rows have their apexes spaced opposite the exterior lattice structure with respect to the interior lattice structure.

8. The structural panel core as defined in claim 1, wherein the plurality of elongate wire segments form a plurality of imaginary pyramids symmetrically arranged throughout the structural panel core.

9. A light-weight structural panel core for forming a wall or the like, comprising:

an interior lattice structure including a first plurality of substantially parallel elongate metal reinforcing members and a second plurality of substantially parallel elongate metal reinforcing members each fixedly interconnected to the first plurality of elongate metal reinforcing members, the first and second reinforcing members defining an interior plane;

an exterior lattice structure including a first plurality of substantially parallel elongate metal reinforcing members and a fourth plurality of substantially parallel elongate metal reinforcing members each fixedly interconnected to the third plurality of elongate reinforcing members, the third and fourth plurality of elongate metal reinforcing members defining an exterior plane substantially parallel to the interior plane;

a filler layer having a substantially uniform thickness and spaced approximately equidistant between the interior and exterior lattice structures;

a plurality of structurally separate elongate metal connecting members each having a straight line configuration between opposing terminal ends of each wire segment and passing through the filler layer for interconnecting the interior lattice structure and the exterior lattice structure, each of the metal connecting members being fixedly secured adjacent a respective opposing terminal end at a compound inclination to each of the interior and exterior lattice structures and at a position spaced from other of the plurality of wire segments, such that each wire segment is structurally supported independent of other of the plurality of wire segments, and such that an inclined angle is formed between each metal connecting member and any plane perpendicular to either the interior and exterior planes; and each of the plurality of metal connecting members forming a side of an imaginary pyramid having remaining sides formed by other of the plurality of metal connecting members, the metal connecting members being fixedly secured to the interior and exterior lattice structures such that an apex of the imaginary pyramid is spaced opposite one of the lattice structures with respect to the other of the lattice structures.

10. The structural panel core as defined in claim 9, wherein one of the first plurality of elongate reinforcing members and an opposing one of the third plurality of elongate reinforcing members profile define a plane perpendicular to both the interior and exterior planes.

11. The structural panel core as defined in claim 9, wherein each of the metal reinforcing members and each of the elongate metal connecting members are formed from wire, and each of the elongate metal connecting members are fixedly interconnected to the interior and exterior lattice structures by welds.

12. The structural panel core as defined in claim 9, wherein the plurality of elongate metal connecting members form a plurality of imaginary pyramids arranged in rows, and wherein a first group of the imaginary pyramids in first rows have their apexes spaced opposite the interior lattice structure with respect to the exterior lattice structure, and wherein a second group of the imaginary pyramids in second rows have their apexes spaced opposite the exterior lattice structure with respect to the interior lattice structure.

13. The structural panel core as defined in claim 9, wherein the plurality of elongate metal connecting members form a plurality of imaginary pyramids symmetrically arranged throughout the structural panel core.

14. A method of forming a light-weight structural panel core for a wall or the like, comprising:

forming an interior lattice structure including a first plurality of substantially parallel elongate reinforcing members and a second plurality of substantially parallel elongate reinforcing members each interconnected to the first plurality of reinforcing members, the first and second plurality of reinforcing members defining an interior plane;

forming an exterior lattice structure including a third plurality of substantially parallel elongate members and a fourth plurality of substantially parallel elongate reinforcing members each fixedly connected to the third plurality of reinforcing members, the third and fourth plurality of reinforcing members defining an exterior plane substantially parallel to the interior plane;

positioning a substantially continuous filler layer between the interior and exterior lattice structures;

passing each of a plurality of structurally separate elongate connecting members having a straight line configuration between opposing terminal ends of each wire segment through a filler layer at a preselected compound inclination to each of the interior and exterior lattice structures, such that an inclined angle is formed between each connecting member and any plane perpendicular to either the interior or exterior planes and each of the plurality of connecting members forms a side of an imaginary pyramid with an apex of the imaginary pyramids spaced opposite one of the lattice structures with respect to the other of the lattice structures; and fixedly connecting an opposing terminal end of each of the connecting members to the interior and exterior lattice structures, respectively, at a position spaced from other of the plurality of wire segments, such that each wire segment is structurally supported by the interior and exterior lattice structures and independent of the other of the plurality of wire segments.

15. The method as defined in claim 14, further comprising:

fixedly welding each of the connecting members to the interior and exterior lattice structures.

16. The method as defined in claim 14, wherein the step of passing each of the plurality of elongate connecting members through the filler layer includes forming a first group of the imaginary pyramids arranged in first rows and having their apexes positioned opposite the interior lattice structure with respect to the exterior lattice structure, and forming a second group of imaginary pyramids arranged in second rows and having apexes positioned opposition the exterior lattice structure with respect to the interior lattice structure.

17. The method as defined in claim 14, wherein the step of passing each of the plurality of elongate connecting members through the filler layer includes forming a plurality of imaginary pyramids symmetrically arranged throughout the structural panel core.

* * * * *

UNITED STATES PATENT AND TRADEMARK OFFICE
CERTIFICATE OF CORRECTION

PATENT NO. : 5,129,203

DATED : July 14, 1992

INVENTOR(S) : Arturo J. Romero

It is certified that error appears in the above-identified patent and that said Letters Patent is hereby corrected as shown below:

In Column 7, line 54, insert --members-- after "reinforcing".

In Column 7, line 58, insert --plurality of-- after "fourth".

In Column 8, line 34, delete "formed from", and insert --metal--.

Signed and Sealed this

Seventh Day of September, 1993

Bruce Lehman

*Attest:*

BRUCE LEHMAN

*Attesting Officer*

*Commissioner of Patents and Trademarks*